US011541518B2

(12) United States Patent
Eggert et al.

(10) Patent No.: US 11,541,518 B2
(45) Date of Patent: Jan. 3, 2023

(54) TOOL HEAD WITH GROOVE FOR REMOVAL FROM LUG

(71) Applicant: Snap-on Incorporated, Kenosha, WI (US)

(72) Inventors: Daniel M. Eggert, Kenosha, WI (US); Jeffrey M. Arendt, Union Grove, WI (US); Glenn A. Kaufman, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 12 days.

(21) Appl. No.: 15/719,223

(22) Filed: Sep. 28, 2017

(65) Prior Publication Data

US 2019/0022834 A1 Jan. 24, 2019

Related U.S. Application Data

(60) Provisional application No. 62/535,636, filed on Jul. 21, 2017.

(51) Int. Cl.
*B25B 23/00* (2006.01)
*B25B 13/06* (2006.01)

(52) U.S. Cl.
CPC ..... *B25B 23/0035* (2013.01); *B25B 13/06* (2013.01)

(58) Field of Classification Search
CPC ... B25B 23/0035; B25B 13/06; B25B 13/065; B25B 13/48; B25B 13/04; B25G 1/102
See application file for complete search history.

(56) References Cited

U.S. PATENT DOCUMENTS 2,262,434 A * 11/1941 Vanerstrom ..... B25B 13/06 81/125
4,367,663 A * 1/1983 Meries ..... B25B 23/0035 81/177.2

(Continued)

FOREIGN PATENT DOCUMENTS

CN 1451520 10/2003
CN 202399193 8/2012

(Continued)

OTHER PUBLICATIONS

Canadian Office Action for Application No. 2,993,689, dated Dec. 3, 2018, 3 pages.

(Continued)

*Primary Examiner* — Joseph J Hail
*Assistant Examiner* — Jonathan R Zaworski
(74) *Attorney, Agent, or Firm* — Seyfarth Shaw LLP

(57) ABSTRACT

Disclosed is a tool head, such as a socket, having an annular groove that allows gripping of the tool head to remove the tool head from a tool having a lug, such as ratchet, torque or impact wrenches. The groove is spaced from the drive engagement end of the socket for improved gripping performance. The groove dimensions were determined to improve gripping performance as well. For example, the groove can have a depth of 0.020"-0.050", preferably 0.020"-0.030". More broadly, the groove can have a depth of 5.0%-15.0%, and preferably 5.0%-10.5%, of the drive end outer diameter. The groove can, either alone or in combination with the above ranges, have a width of 0.25-0.47", preferably 0.29-0.43". The groove can, either alone or in combination with the above ranges, begin at a distance of 0.070-0.160", preferably 0.090-0.140", and have an end of groove farthest from the end of the socket of 0.32-0.63", preferably 0.38-0.57".

18 Claims, 3 Drawing Sheets

(56) References Cited

U.S. PATENT DOCUMENTS

| | | | | | |
|---|---|---|---|---|---|
| 4,480,511 | A * | 11/1984 | Nickipuck | B25B 23/0035 | 81/177.85 |
| 4,759,122 | A * | 7/1988 | Weintraub | B25B 13/48 | 81/439 |
| 5,074,524 | A * | 12/1991 | Wade | F16L 37/23 | 251/149.6 |
| 5,485,769 | A * | 1/1996 | Olson | B25B 23/0035 | 81/177.85 |
| 5,813,296 | A * | 9/1998 | Hoff | B25B 23/0035 | 81/177.85 |
| 5,860,338 | A * | 1/1999 | Littlefield | B25B 15/001 | 81/177.85 |
| 6,354,176 | B1 * | 3/2002 | Nordlin | B25B 13/06 | 81/121.1 |
| 6,497,120 | B1 * | 12/2002 | Kozora | C03B 9/1932 | 29/428 |
| 6,761,093 | B2 * | 7/2004 | Chang | G09F 3/00 | 81/DIG. 5 |
| 7,028,588 | B2 * | 4/2006 | Shih | B25B 13/56 | 81/DIG. 5 |
| 7,104,164 | B2 * | 9/2006 | Jirele | B25B 23/108 | 81/124.6 |
| 7,127,969 | B2 * | 10/2006 | Hsieh | B25B 13/06 | 81/120 |
| 7,987,748 | B2 * | 8/2011 | Chiu | B25G 1/00 | 81/DIG. 5 |
| 8,690,164 | B2 * | 4/2014 | Meng | B25B 23/0035 | 279/22 |
| 9,027,445 | B2 * | 5/2015 | Sumg | B25B 13/58 | 81/125 |
| 9,144,893 | B2 * | 9/2015 | Su | B25B 23/0035 | |
| 9,156,146 | B1 * | 10/2015 | Maceo | B25B 23/0035 | |
| 9,406,423 | B1 * | 8/2016 | Tsai | B25B 13/06 | |
| 9,573,255 | B2 * | 2/2017 | Pamatmat | B25B 23/0035 | |
| 9,827,654 | B2 * | 11/2017 | Su | B25B 23/0007 | |
| 9,956,670 | B2 * | 5/2018 | Feuerstein | B25B 23/0021 | |
| 10,093,005 | B2 * | 10/2018 | Zhang | B25B 15/001 | |
| 10,792,793 | B2 * | 10/2020 | Moss | B25B 23/12 | |
| 2002/0011135 | A1 * | 1/2002 | Hall | B25B 13/06 | 81/124.4 |
| 2003/0154827 | A1 | 8/2003 | Chang | | |
| 2004/0093997 | A1 * | 5/2004 | Huang | B25B 15/001 | 81/125 |
| 2004/0216566 | A1 * | 11/2004 | Shih | B25B 13/56 | 81/119 |
| 2005/0193874 | A1 * | 9/2005 | Shih | B25B 13/56 | 81/121.1 |
| 2006/0027054 | A1 * | 2/2006 | Wang | G09F 7/165 | 81/180.1 |
| 2008/0148910 | A1 * | 6/2008 | Chiu | B25B 13/46 | 81/488 |
| 2011/0100167 | A1 | 5/2011 | Tsai | | |
| 2011/0185860 | A1 * | 8/2011 | Chang | B25B 13/06 | 81/124.6 |
| 2012/0031242 | A1 * | 2/2012 | Li | B25B 13/06 | 81/184 |
| 2014/0196581 | A1 * | 7/2014 | Su | B25B 23/0007 | 81/438 |
| 2014/0260826 | A1 | 9/2014 | Eggert et al. | | |
| 2015/0321324 | A1 * | 11/2015 | Su | B25B 13/56 | 81/438 |
| 2016/0016298 | A1 * | 1/2016 | Zhang | B25B 15/001 | 81/451 |
| 2016/0140880 | A1 | 5/2016 | Su | | |
| 2017/0014990 | A1 | 1/2017 | Grinwald et al. | | |
| 2018/0021927 | A1 * | 1/2018 | Lin | B25B 13/06 | 81/121.1 |

FOREIGN PATENT DOCUMENTS

| | | | |
|---|---|---|---|
| CN | 103934785 | A | 7/2014 |
| CN | 105082029 | A | 11/2015 |
| DE | 202015003738 | | 12/2015 |
| EP | 2098337 | | 1/2009 |
| GB | 2429670 | | 3/2007 |
| KR | 19980022479 | | 7/1998 |
| TW | 200600282 | A | 1/2006 |
| TW | M286095 | U | 1/2006 |
| TW | M312390 | | 5/2007 |
| TW | M349316 | | 1/2009 |
| TW | M385435 | | 8/2010 |
| TW | D140637 | | 5/2011 |
| TW | I444255 | B | 7/2014 |
| TW | D166798 | | 4/2015 |
| TW | M527812 | | 9/2016 |
| TW | 201703942 | | 2/2017 |
| WO | 2017106701 | | 6/2017 |

OTHER PUBLICATIONS

Combined Search and Examination Report for UK Application No. GB1801707.9 dated Jul. 19, 2018, 8 pages.
Examination Report No. 3 for Australian Application No. 2018200768 dated Feb. 7, 2020, 4 pages.
Canadian Office Action for Application No. 2,993,689, dated Sep. 16, 2019, 3 pages.
UK Examination Report for Application No. GB18801707.9, dated Aug. 19, 2019, 3 pages.
Chinese Office Action for Application No. 201810382426.6 dated Mar. 4, 2020, 8 pages.
UK Office Action for Application No. GB2000676.3 dated Jun. 18, 2020, 6 pages.
Canadian Office Action for Application No. 2,993,689 dated Aug. 31, 2020, 3 pages.
Australian Office Action for Application No. 2020200906 dated Sep. 25, 2020, 4 pages.
Australian Office Action for Application No. 2018200768 dated Feb. 3, 2020, 3 pages.
Chinese Office Action for corresponding Chinese Application No. 201810382426.6 dated May 14, 2021, 4 pages.
Examination Report No. 2 for Application No. 2020200906 dated Feb. 26, 2021, 3 pages.
Canadian Office Action for Application No. 2,993,689 dated May 3, 2021, 3 pages.
Decision on Petition for corresponding Taiwan Application No. D203855 dated Oct. 26, 2021, 6 pages.
Chinese Office Action for corresponding Chinese Application No. 201810382426.6 dated Aug. 17, 2021, 4 pages.
Australian Examination Report No. 1 for Application No. 2018200768 dated Feb. 7, 2019, 4 pages.
Taiwan Office Action for Application No. 1071249239, dated Apr. 24, 2019, 7 pages.

* cited by examiner

TOOL HEAD WITH GROOVE FOR REMOVAL FROM LUG

TECHNICAL FIELD OF THE INVENTION

The present invention relates generally to a tool heads, such as sockets. More particularly, the present invention relates to a tool head, such as a socket, having an annular groove for easy removal from a lug.

BACKGROUND OF THE INVENTION

Tool heads, such as, for example, sockets, are a popular form of engaging and then applying torque to work pieces, such as bolts, nuts, screws, or other work pieces. Sockets are elongated, cylindrical pieces that engage the work piece head at a working end and connect to a torque application tool having a lug, for example a socket wrench, torque wrench or impact driver, at a drive end opposite the working end. The socket can apply torque to a work piece to either insert or remove the work piece from a working material by transferring the torque applied by the wrench connected to the work piece.

Tool heads can be different sizes or shapes to account for different sized or shaped work pieces. For example, a bolt having a hexagonal head that is ½" wide can be torqued with a ½" socket. Such a socket would typically include a ¼", ⅜", or ½" square female aperture that would be matingly coupled with a torque application tool having a similarly ¼", ⅜" or ½" square male drive lug. The socket/torque application tool engagement also typically includes a detent mechanism, such as where the square aperture includes an indent that detentably engages an outwardly biased ball disposed on the drive lug to detain the socket on the drive lug. Typically, the ball is outwardly biased with a compression spring. When the torque application operation is complete, or the socket needs to be changed or otherwise removed from the torque application tool, the socket can thus be forcibly removed from the lug by applying an outward force that causes the detent to overcome the outward bias of the ball in the detent mechanism.

However, tool heads can sometimes be difficult to remove from a torque application tool lug, for example, when the ball detent is biased with excessive force, or when the ball detent is worn, rusted or otherwise difficult to move. Also, sometimes during the torque application procedure, the socket female aperture rotates slightly relative to the drive lug, causing the socket to become stuck on the lug.

Prior socket heads have implemented a cutout section to improve gripping during removal. For example, as shown in FIG. 5, prior sockets are shown with a smaller 500*a* working end 505 and a larger 500*b* working end 505, as compared to the drive end 510. The drive end 510 includes a square drive 515 and a ball detent 525, as with conventional sockets. However, the sockets 500*a,b* also include a ring 535 that is cut out as compared to a lip 537 adjacent the ring 535. A user can then grip the ring 535 and use the lip 537 to assist with removal of the socket 500*a,b*. However, the ring 535 and lip 537 combination is still difficult to grip and remove, and lacks dimensions that permit efficient removal of the socket from the wrench.

SUMMARY OF THE INVENTION

The present invention broadly comprises a tool head, such as a socket, having an annular groove that allows better gripping of the socket by a user to assist with removal of the tool head from the lug of a tool, such as, for example, a ratchet, torque or impact wrench or breaker bar. The groove can begin at a point that is spaced from the drive end of the tool head to improve grip. The groove can also be dimensioned to improve gripping and removal performance. For example, the groove can have a depth of 0.020-0.050", preferably 0.020-0.030". More broadly, the groove can have a depth of 5.0%-15.0%, preferably 5.0%-10.5%, of the drive end outer diameter. The groove can, either alone or in combination with the above ranges, have a width of 0.25-0.47", preferably 0.29-0.43". The groove can, either alone or in combination with the above ranges, begin at a distance of 0.070-0.160", preferably 0.090-0.140", and have an end of groove farthest from the end of the socket of 0.32-0.63", preferably 0.38-0.57".

In an embodiment, the present invention can include a tool head, such as a socket, including a working end that engages a work piece, such as, for example, a hexagonal head of the work piece, a drive end opposite the working end that includes a female aperture that matingly engages a male lug of a tool, such as a ratchet, impact or torque wrench or breaker bar, wherein the aperture and lug further includes cooperative detent mechanisms, such as an indent disposed in a sidewall of the aperture and a corresponding outwardly biased ball disposed on the lug that detaintably engages the indent. The tool head further includes a first rim proximate the working end, a second rim proximate the drive end, and an annular groove located between the first and second rims.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
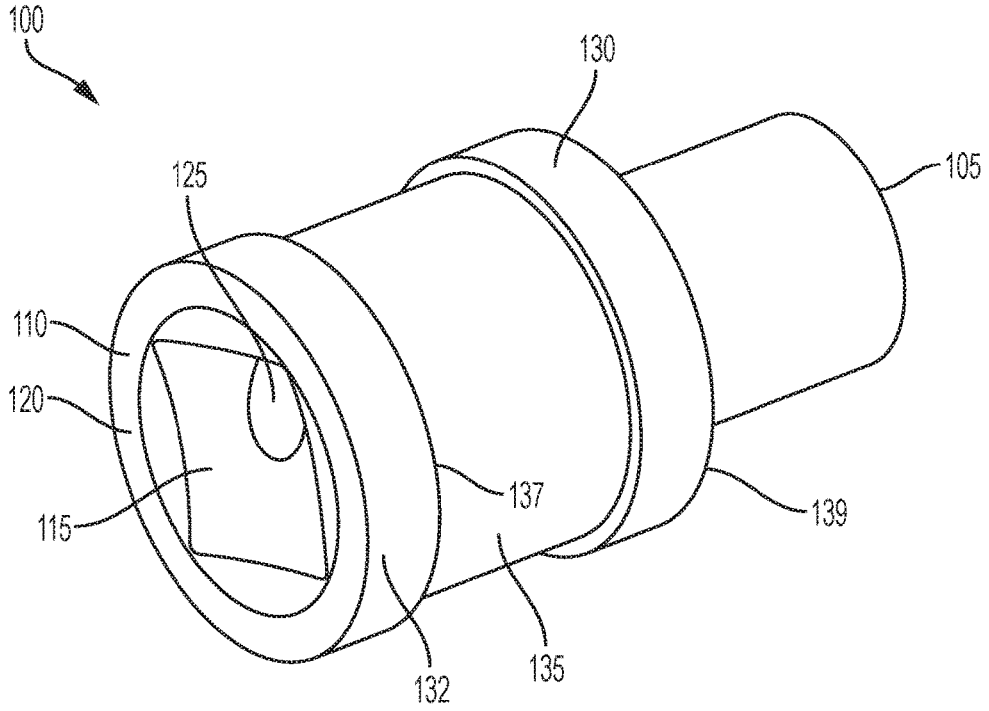
FIG. 1 is a side perspective view of a tool head, such as a socket, with a working end having a smaller diameter than a drive end according to at least some embodiments of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

It will be appreciated that while the present invention is disclosed and described as a socket, the present invention is applicable and usable with any type of tool head adapted to engage a work piece, wherein the tool head has an aperture or bore that is adapted to matingly engage a tool having a lug, such as, for example and without limitation, a screw driver head.

The present invention broadly comprises a tool head, such as a socket, having an annular, circumferential groove that is sized and shaped to improve gripping by a user during removal of the tool head from a tool having a lug, such as, for example, a ratchet wrench, torque wrench, impact wrench, breaker bar or handled tool. It will be understood that the present invention is not limited to any particular tool, but can be used with any tool having a lug. In an embodiment, the groove is spaced from an end of the drive end of the tool head to allow better gripping, and can be further dimensioned to improve the ability to remove the tool head from a tool. For example, and without limitation, the groove can have a depth of approximately 0.020"-0.050", and preferably 0.020"-0.030". More broadly, the groove can have a depth of approximately 5.0%-15.0%, and preferably 5.0%-10.5%, of the drive end outer diameter. The groove can, either alone or in combination with the above ranges, have a width of 0.25-0.47", preferably 0.29-0.43". The groove can, either alone or in combination with the above ranges, begin at a distance of 0.070-0.160", preferably 0.090-0.140", and have an end of groove farthest from the end of the socket of 0.32-0.63", preferably 0.38-0.57".

Figure 2:
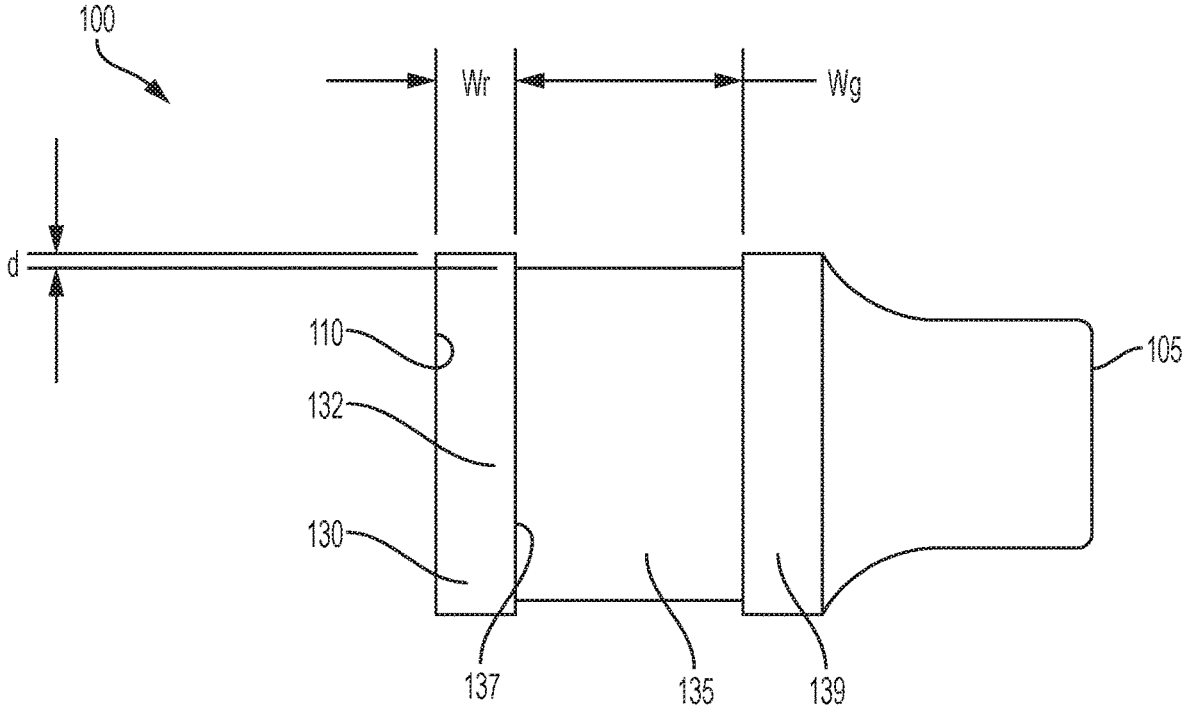
FIG. 2 is a side elevation view of a tool head, such as a socket, with a working end having a smaller diameter than a drive end according to at least some embodiments of the present invention.

Referring to FIGS. 1-2, there is illustrated a tool head 100, such as a socket, with a working end 105 of the socket that is smaller than the drive end 110 of the socket 100. Conversely, referring to FIGS. 3-4, there is illustrated a tool head 300, such as a socket, having a working end 305 of the tool head 300 that has a similar or larger diameter than the drive end 310 of the tool head 300, with similar elements having similar numbering as those elements illustrated in FIGS. 1-2.

With reference to FIGS. 1-2, a tool head 100 includes a working end 105 and an opposing drive end 110. Near the drive end 110, the tool head 100 can include a female aperture 115, for example, a square shaped bore, that is adapted to be releasably mated with a square male lug of a tool. The aperture 115 can be located within a drive end outer diameter 120, and can further include an indent 125 disposed on an inner surface thereof that is adapted to detainably engage an outwardly biased ball disposed on the male lug of the tool. It will be appreciated that the any one or more of the inner surfaces of the aperture can include an indent 125. Closer to the working end 105 can be a first rim 130 and closer to the drive end 110 can be a second rim 132. Between the two rims 130, 132 can be an annular groove 135 that a user can grip to remove the tool head 100 from the lug of a tool when removal is desired.

Figure 3:
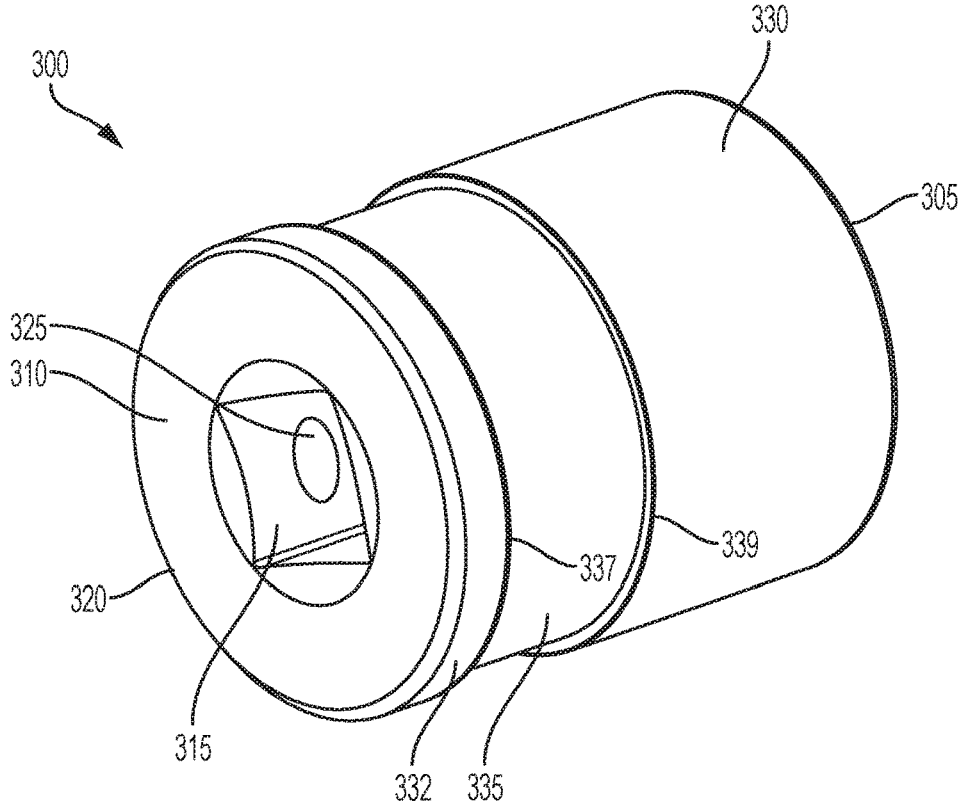
FIG. 3 is a side perspective view of a tool head, such as a socket, with a working end having a similar or larger diameter than a drive end according to at least some embodiments of the present invention.
Figure 4:
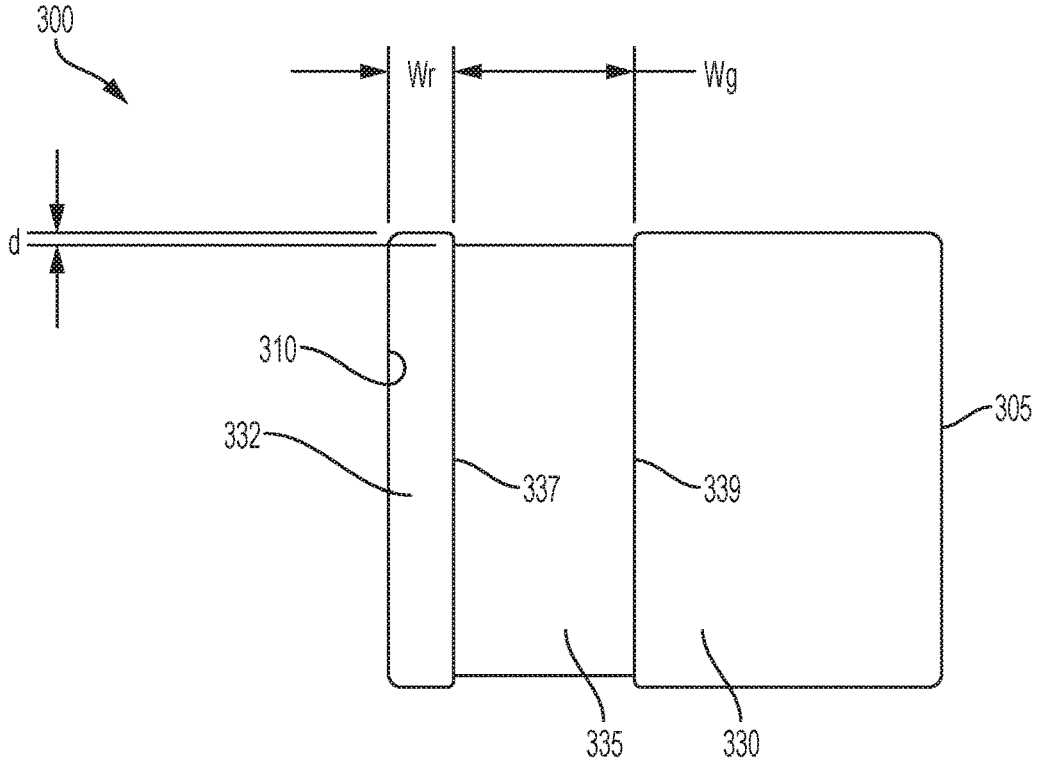
FIG. 4 is a side elevation view of a tool head, such as a socket, with a working end having a similar or larger diameter than a drive end according to at least some embodiments of the present invention.
Figure 5A:
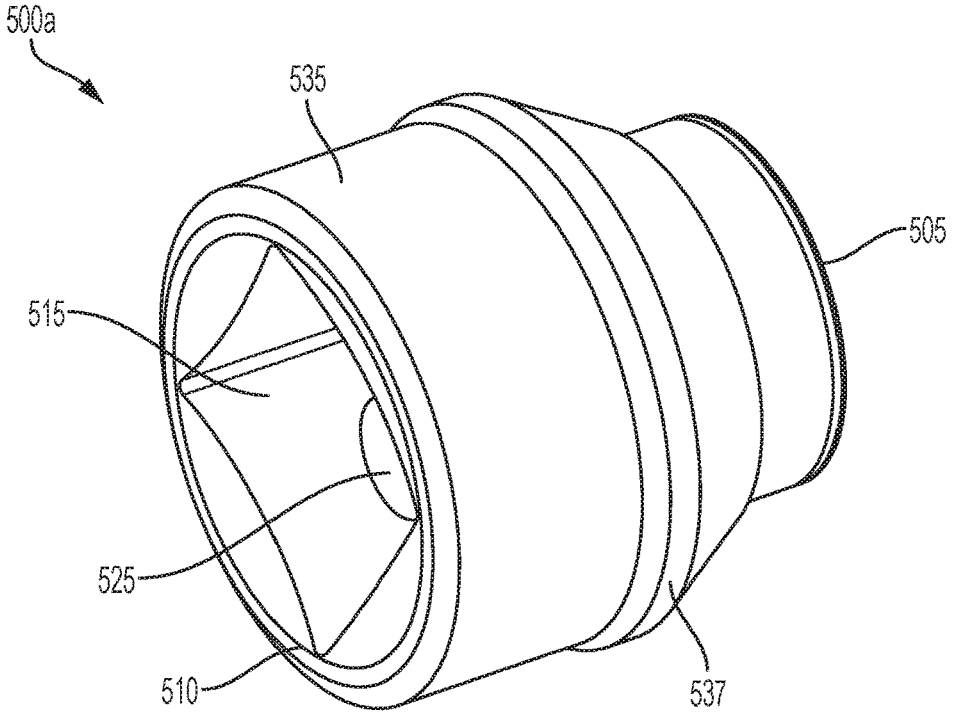
FIG. 5A PRIOR ART
FIGS. 5*a* and 5*b* are side perspective views of prior art sockets having respective smaller and larger working end diameters than drive ends.
Figure 5B:
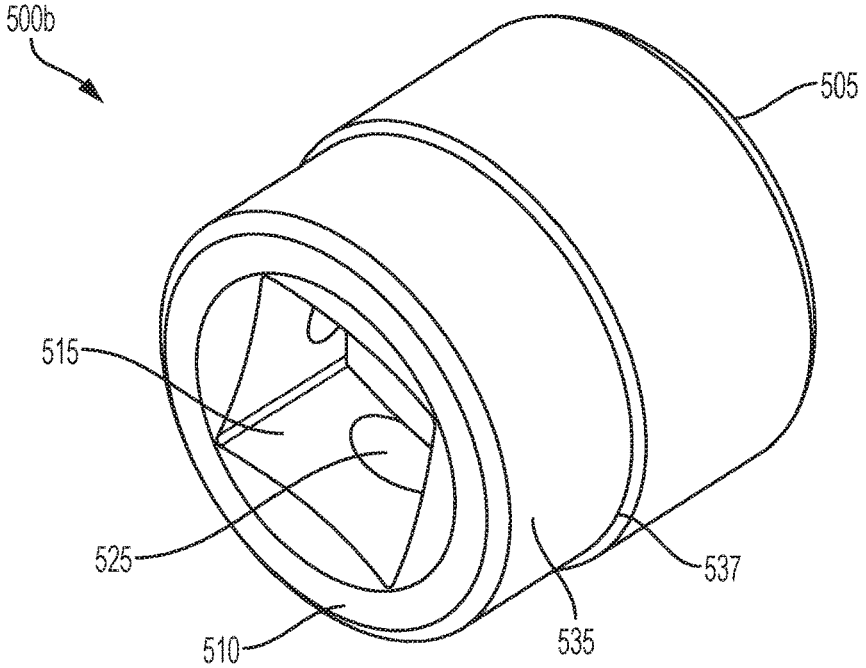
FIG. 5B PRIOR ART

Referring also to FIGS. 3-4, through testing, it has been determined by the inventors of the present invention that certain size ranges provide the best grip and removal properties for the groove 135, 335, and outside these ranges, the gripping properties became worse. For example, the inventors determined that the annular groove 135, 335 should have a depth (shown as "d" in FIGS. 2 and 4) of approximately 0.020"-0.050", and preferably 0.020"-0.030". It has been determined that the groove 135, 335 should have a depth d of approximately 5.0%-15.0%, and preferably 5.0%-10.5%, of the drive end outer diameter 120, 320. The annular groove 135, 335 can, either alone or in combination with the above ranges, have a width $W_g$ of approximately 0.25-0.47", preferably 0.29-0.43".

The inventors also determined that the spacing of the annular groove 135, 335 from the drive end 110 is also beneficial to gripping and removal properties of the present invention. For example, the annular groove 135, 335 can include a first groove end 137, 337 spaced a distance $W_r$ from the drive end 110 of the socket 100, 300. The groove 135, 335 can further include a second groove end 139, 339 spaced a distance of $W_g$ from the first groove end 137, 337. The inventors of the present invention discovered that the groove 135, 335 can, either alone or in combination with the above ranges, have an end of groove farthest from the drive end 105 (i.e., the second groove end 139, 339) of the socket 100 ($W_r$+$W_g$) of 0.32"-0.63", preferably 0.38"-0.57".

Based on the above parameters, the inventors determined that the groove 135, 335 according to the present invention improves gripping properties of the tool head and assists with the removal of the tool head 100, 300 from the lug of a tool. The structure and dimensions of the groove 135, 335 provide this advantage, not seen in the prior art.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool head, comprising:

a working end adapted to engage a work piece;

a drive end opposite the working end and having a drive end outer diameter and an aperture adapted to detainably engage a lug of a tool;

first and second rims, wherein the first rim has a first rim diameter that is substantially the same as the drive end outer diameter, and the second rim is disposed proximate to the drive end and has a second rim width; and an annular groove disposed between the first and second rims, and having a groove width that is 0.25-0.47 inches, and a groove depth that is 5%-15% of the drive end outer diameter.

2. The tool head of claim 1, wherein the groove depth is 0.020-0.050 inches.

3. The tool head of claim 2, wherein the groove depth is 0.020-0.030 inches.

4. The tool head of claim 1, wherein the groove depth is 5.0%-10.5% of the drive end outer diameter.

5. The tool head of claim 1, wherein the groove includes a first groove end proximate to the drive end, and a second groove end, and wherein the second groove end is located 0.32-0.63 inches from the drive end.

6. The tool head of claim 1, wherein the groove includes a first groove end proximate to the drive end, and a second groove end, and wherein the first groove end is located 0.070-0.160 inches from the drive end.

7. A tool head, comprising:

a working end adapted to engage a work piece;

a drive end opposite the working end and having a drive end outer diameter and an aperture adapted to matingly engage a lug of a tool, and an indent disposed on an inner surface that is adapted to engage an outwardly biased ball disposed on the lug to detain the tool head on the lug;

first and second rims, wherein the second rim is proximate to the drive end and has a second rim width; and an annular groove disposed between the first and second rims, and including a first groove end proximate the drive end, a second groove end, and a groove width and a groove depth, wherein the groove depth is 5.0%-15.0% of the drive end outer diameter, the groove width is 0.25-0.47 inches, and the first groove end is located 0.070-0.160 inches from the drive end.

8. The tool head of claim 7, wherein the groove depth is 5.0%-10.5% of the drive end outer diameter.

9. The tool head of claim 7, wherein the groove depth is 0.020-0.050 inches.

10. The tool head of claim 9, wherein the groove depth is 0.020-0.030 inches.

11. The tool head of claim 7, wherein the second groove end is located 0.32-0.63 inches from the drive end.

12. The tool head of claim 1, wherein the aperture is a square aperture.

13. The tool head of claim 7, wherein the first groove end is located 0.090-0.140 inches from the drive end.

14. A tool head, comprising:

a working end adapted to engage a work piece;

a drive end opposite the working end and having a drive end outer diameter and an aperture adapted to detainably engage a lug of a tool; and an annular groove disposed between the working end and the drive end, and including a first groove end proximate the drive end, a second groove end, a groove width that is 0.25-0.47 inches, and a groove depth that is 5%-15% of the drive end outer diameter, wherein the first groove end is located 0.070-0.160 inches from the drive end.

15. The tool head of claim 14, wherein the groove depth is 5.0%-10.5% of the drive end outer diameter.

16. The tool head of claim 14, wherein the first groove end is located 0.090-0.140 inches from the drive end.

17. The tool head of claim 14, wherein the second groove end is located 0.32-0.63 inches from the drive end.

18. The tool head of claim 17, wherein the second groove end is located 0.38-0.57 inches from the drive end.

* * * * *